United States Patent [19]

Kosof

[11] Patent Number: 4,597,575

[45] Date of Patent: Jul. 1, 1986

[54] METHOD OF PLAYING A BOWLING GAME

[76] Inventor: Max E. Kosof, 5480 S. 1225 East, Ogden, Utah 84403

[21] Appl. No.: 283,225

[22] Filed: Jul. 14, 1981

Related U.S. Application Data

[63] Continuation-in-part of Ser. No. 134,921, Mar. 28, 1980, abandoned.

[51] Int. Cl.[4] ..... A63D 5/00

[52] U.S. Cl. ..... 273/37; 273/54 C

[58] Field of Search ..... 273/54 R, 54 C, 37

[56] References Cited

U.S. PATENT DOCUMENTS 3,212,780 10/1965 Jewell ..... 273/54 C

*Primary Examiner*—Anton O. Oechsle

*Attorney, Agent, or Firm*—William H. Drummond

[57] ABSTRACT

A method of playing a bowling game comprising the steps of requiring each player to deliver at least one of a preselected number of balls in each of a plurality of frames, counting the number of balls delivered by each player in each frame and the number of pins remaining standing at the end of the frame, adding these numbers together to determine a frame score, recording each player's frame score, adding each player's frame scores to determine the total game score, and comparing the player's game scores to determine the winner of the game.

1 Claim, 4 Drawing Figures

METHOD OF PLAYING A BOWLING GAME

This application is a continuation-in-part of co-pending application Ser. No. 134,921, filed Mar. 28, 1980, now abandoned.

This invention relates to a method for playing a bowling game.

In another respect, the invention concerns a bowling method in which the players each bowl the same preselected number of frames and in which the resulting player's scores more consistently and more directly reflect the actual performance and abilities of the players.

In yet another respect, the invention pertains to a bowling method which is readily understood and which requires less skill and experience than the conventional bowling scoring system.

In still another aspect, the invention pertains to a bowling method in which winning the game is not dependent on the sequence in which the players make "strikes" and/or "spares", such that the lead among players can readily shift from frame to frame, even towards the end of the game.

In the conventional method of playing a bowling game, the determination of the winner is highly dependent on the specific sequence in which the players score strikes and spares, in addition to being dependent on other relevant factors such as the inherent abilities of the bowlers and the general level of their performance in each particular game. Consequently, bowling games among the players in a given game or in comparison to other players in the same league played according to the conventional rules, do not furnish an accurate comparison of the actual abilities and levels of performance of the various players. In addition, in the conventional bowling method, in which a "strike" or a "spare" entitles the player to add pin count for pins knocked down in subsequent frames to the pin count which he obtains in a preceding frame, is cumbersome and difficult for many players to learn and understand the rules. In fact, many players who bowl frequently never learn or understand the conventional bowling rules, and must rely on others to keep score and never understand the effect which will be obtained if they score a strike or spare in a later frame.

The lack of a bowling game which gives a direct comparison of the skills and levels of performance among players leads to confusion in assigning handicaps for tournament play and makes it much more difficult for a player to assess his own abilities in comparison with others in his own league or in other geographical areas. The difficulty in understanding and learning the conventional bowling game is sufficiently frustrating that many players eventually give up the game.

Finally, since the game score which will be achieved according to conventional bowling game playing methods is highly dependent on the specific timing of the making of strikes and spares, it is common for one player in a group to achieve such a commanding lead in the early frames that the other players have no hope of winning the game even though their performance improves considerably in the later frames. This reduces the overall level of competitive challenge throughout the game.

Accordingly, it would be highly desirable to provide a method of playing bowling which is simplified, such that even beginning players, including children, can readily understand and practice it. Additionally, it would be highly desirable to provide a bowling game playing method which yields a much more accurate comparison of the skills and levels of performance among various players. Further, it would be highly desirable to provide a bowling game playing method in which one player cannot achieve a commanding lead early or late in the game by the fortuitous circumstance of stringing several strikes and spares consecutively, whereas other players in the game who make the same number of strikes and spares but not consecutively are unduly penalized.

Accordingly, it is a principal object of the invention to provide a bowling playing method which is simplified and easier to learn and understand.

Yet another object of the invention is to provide such a method in which the game results more accurately reflects the true abilities and performance of the player.

Still another object of the invention is to provide a bowling playing method which leads to an overall increase in the general level of competition throughout the game.

These and other, further and more specific objects and advantages of the invention will be apparent to those skilled in the art from the following detailed description thereof, taken in conjunction with the drawings, in which.

Figure 1:
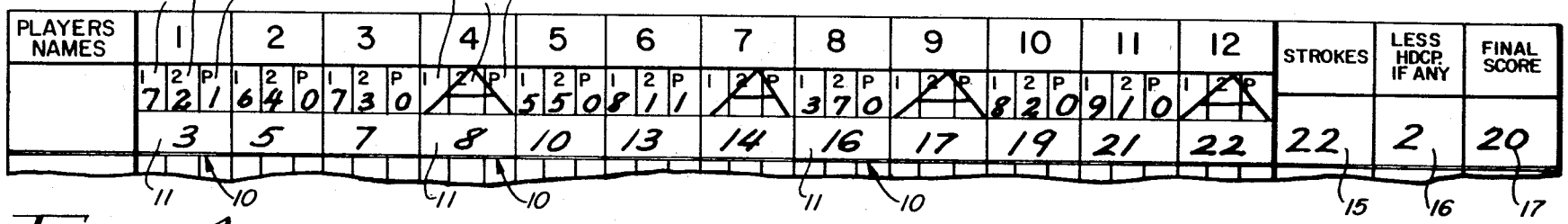
FIG. 1 illustrates a score sheet and a hypothetical game by one player played in accordance with the method of the present invention.

Briefly, in accordance with the invention, I provide a method for playing a bowling game in which players are allowed a preselected maximum number of balls to knock down all pins in each of a preselected plurality of frames, comprising the steps of requiring each player to deliver at least one of said preselected maximum number of balls in each of said frames; counting the number of balls delivered by each player in each frame and the number of each player's pins remaining standing at the end of said frame; adding the number of balls delivered by each player in each frame to the number of each player's pins remaining standing at the end of said frame, to determine a score for each player for each frame; recording each player's frame score; adding each player's frame scores to determine said player's total score for the game; and comparing the player's game scores to determine the winner of the game.

According to the method of the invention, considered in its broadest aspect, the game is scored frame by frame, with the total score being the sum of the individual frame scores, and each bowler bowls the same preselected number of frames. By contrast, according to the conventional bowling games, the frame score of any individual frame depends on what happens in the next frame and, except for the first frame, on what happened in the preceding frame. Furthermore, the players do not necessarily bowl the same number of frames as, depending on the game history, some players may bowl 10 frames, some 11 frames, and some 12 frames.

According to the present invention the game is played by adding the number of balls delivered which are required to knock down the pins in each frame (with the maximum number of balls delivered per frame being preselected) to the number of pins remaining standing at the end of the frame. Thus, for example, if the player is allowed two balls delivered per frame and knocks down eight pins with the first ball delivered and the remaining two pins with the second ball delivered, the frame score will be "2". If the bowler knocks down nine pins with the first ball and misses the remaining pin with the second ball, the frame score is "3". If the bowler knocks down all of the pins on the first ball, the frame score is "1". The total game score is simply the sum of the individual frame scores and the player with the lowest score wins the game and, thus, a perfect game score according to the present invention is "12" if there are twelve frames in the game. On the other hand, scored according to the conventional method, the perfect score for twelve frames is "300", which is mathematically impossible and artificial.

The game of the present invention and the presently preferred embodiment thereof is further illustrated in the drawings, which depict hypothetical games played according to the conventional method in comparison with the same games played according to the method of the present invention. The drawings also depict a convenient score sheet which I have devised for use in practicing the method of the present invention.

Referring to FIG. 1, which illustrates the game which I have devised, it will be noticed that the hypothetical game consists of twelve frames, with a maximum of two balls deliverable allowed per frame and ten pins are addressed at the beginning of each frame. However, it will be understood by those skilled in the art, that the number of frames, the number of deliveries allowed per frame and the number of pins addressed at the beginning of each frame can be varied, as desired. For example, the game might be played with ten frames, three balls deliverable per frame and five pins addressed per frame, and the method of the present invention would be equally applicable to scoring such a game.

The score sheet depicted in FIG. 1 provides twelve separate spaces 10 for scoring each frame and each such space 10 is divided into a lower half 11 which is used to record the running score. The upper half of each space 10 is divided into three separate spaces 12, 13 and 14. The spaces 12 are used to record the number of pins knocked down by the first ball delivered in each frame 10. The spaces 13 are used to record the number of pins knocked down by the second ball of each frame 10, and the spaces 14 are used to record the number of pins remaining standing at the end of each frame 10. When a player knocks down all pins presented with the first ball delivered in each frame, a characteristic mark, such a "A", is placed across the squares 12, 13 and 14, indicating a perfect score of "1" for that frame.

In the hypothetical game of FIG. 1, the player knocked down seven pins with the first ball delivered in frame 1 and two more pins with the second ball delivered in frame 1. The two balls delivered, plus the one pin remaining standing at the end of frame 1 yields a frame score of "3". The spaces 12, 13 and 14 provide a convenient check to insure that the scoring is correct as, in each frame, the spaces 12, 13 and 14 added across must equal the number of pins addressed in the beginning of the frame, in this case 10.

In frame 2 of the game of FIG. 1, the player knocked down six pins with the first ball and the remaining four pins with the second ball. No pins were left standing at the end of the frame and the two balls delivered plus zero pins remaining equal a frame score of "2", which is added to the frame score of frame 1 to yield the running score "5" in space 11 of the second frame. In frame 3, the player again knocked down all pins with two balls, yielding a frame score of "2", which is added to the running score of frame 2, yielding a running score of "7" in space 11 in the third frame.

In frame 4 of the game of FIG. 1, the player knocked down all of the pins with the first ball, yielding a perfect frame score of "1" which, added to the running score of "7" of frame 3, yields the running score "8" in space 11 of the fourth frame.

Play proceeds according to the hypothetical game of FIG. 1, with the results being entered as described above in the remaining frames and the individual frame scores, presented as a running score in the bottom space 11 of each frame 10, added together yields the total game score "22" shown in the space 15. A handicap may be deducted and, if so, is shown in the space 16, yielding the final score shown in space 17.

Figure 2:
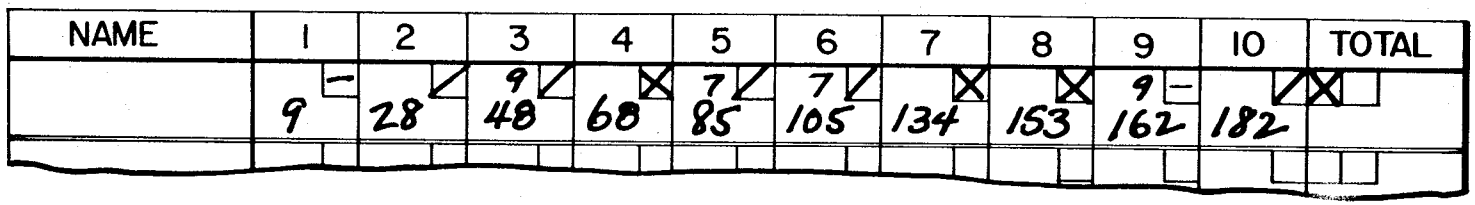
FIG-2 (PRIOR ART)
FIG. 2 illustrates the hypothetical game of FIG. 1 played in accordance with the conventional bowling method.

If the hypothetical game of FIG. 1 is played in accordance with the conventional bowling method, the results are those shown in FIG. 2. Since nine pins were knocked down with both balls of the first frame, the score for that frame is "9". However, in frame 2, where all pins were knocked down with the two balls, the player scored a "spare" and the actual score for frame 2 would depend on how many pins were knocked down with the first ball of frame 3. Since nine pins were knocked down with the first ball of frame 3, a total of 19 "pins" were added to the score of the first frame, for a score in frame 2 of "28". The player again scored a spare in frame 3, therefore leaving that frame unscored until the first ball of frame 4 determined the total number of pins to be added. Since the first ball of frame 4 knocked all of the pins down, a total of 20 pins were added to the score of the second frame, for a score in frame 3 of "48". Having scored a "strike" in frame 4, the player then gained the advantage of adding the next two succeeding balls' score to the score of frame 3 to achieve the score for frame 4—in this case, the additional ten pins knocked down by virtue of the spare in frame 5. Accordingly, the score for frame 4 becomes "68". Play continues accordingly, with a "spare" allowing the player to add the pins knocked down with the first ball of the next frame to the ten knocked down for the preceding frame, and a "strike" allowing the player to add the pins knocked down with the next two balls to the ten knocked down for the frame in which the "strike" is scored. It will also be noted that scoring a "spare" in the tenth frame allows the player to add the number of pins knocked down with one more ball, thus giving the player 11 frames of play instead of 10.

As will be observed by comparing FIGS. 1 and 2, the score "182" does not have any physical significance in determining the actual level of skill of the player, since a large number of the total points are due to the fact that the player scored successive spares and strikes in frames 2–8. Also, by scoring a spare in the 10th frame, the player was allowed to play one additional frame.

Figure 3:
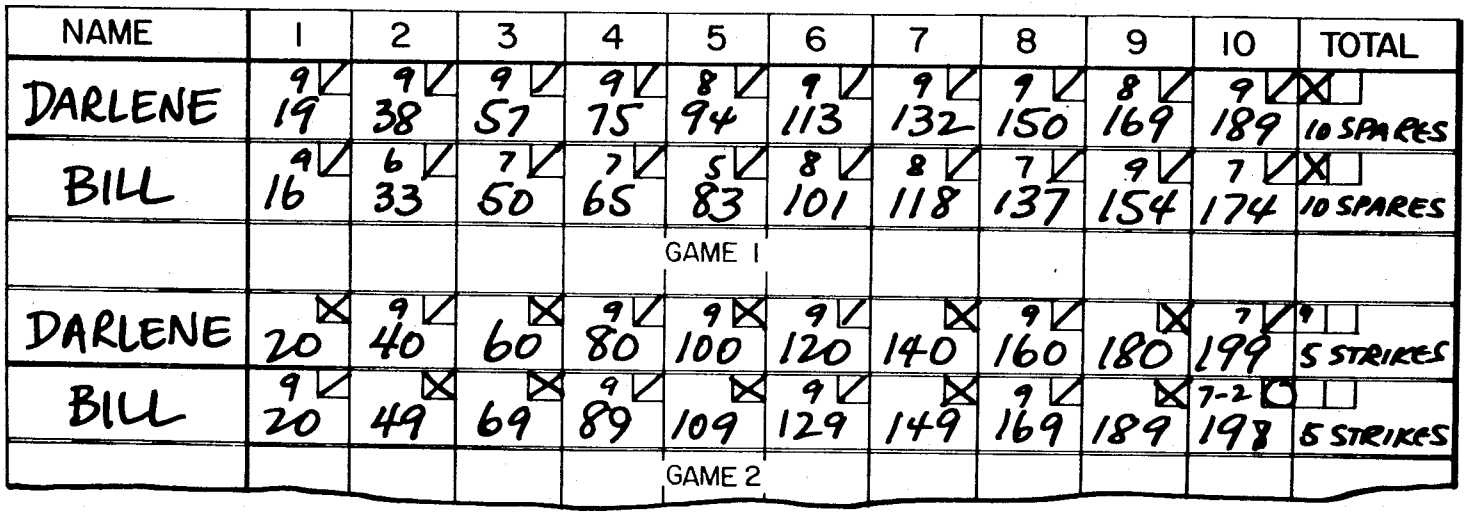
FIG-3 (PRIOR ART)
FIG. 3 illustrates two hypothetical bowling games between two players, played according to the conventional bowling method.
Figure 4:
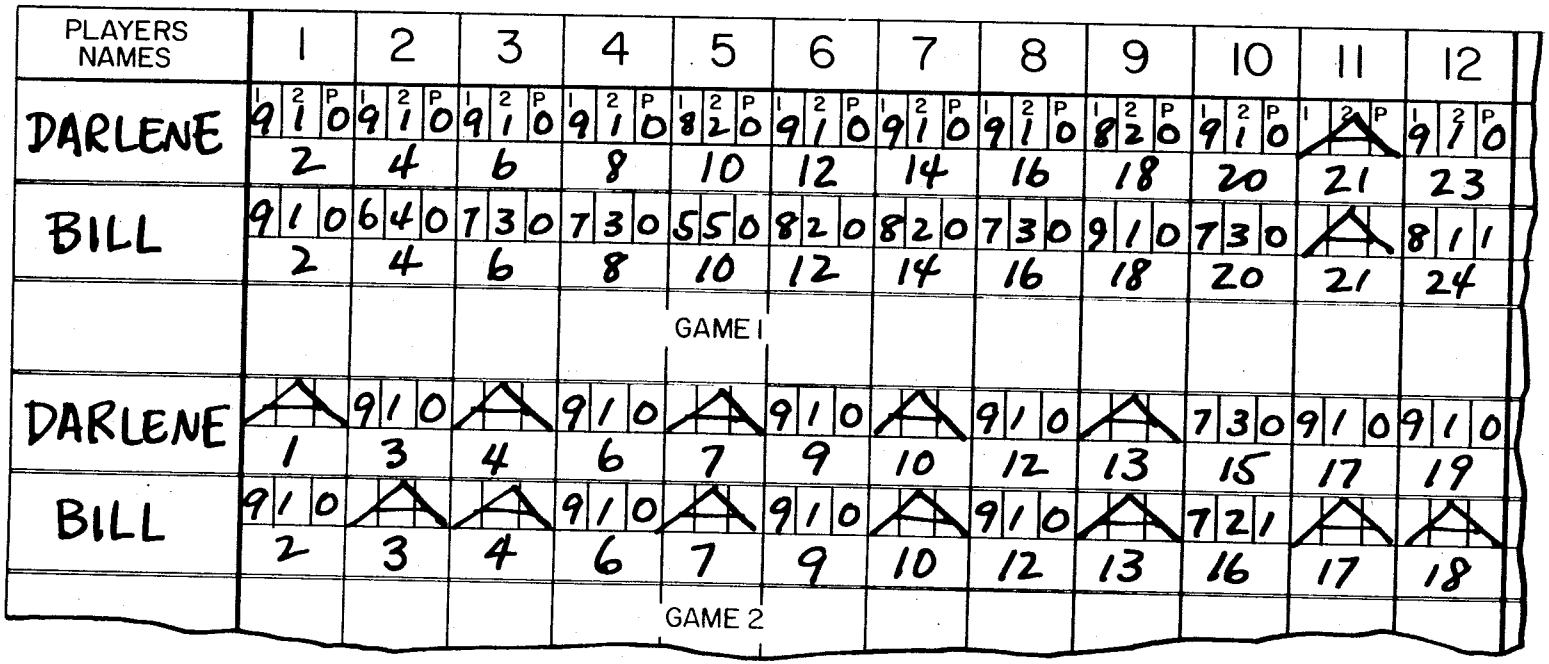
FIG. 4 illustrates the same two hypothetical games, played according to the method of the present invention.

To further illustrate the practice of and advantages of the game of the present invention, FIGS. 3 and 4 illustrate two hypothetical bowling games between two players, scored according to the conventional scoring method (FIG. 3) and according to the method of the present invention (FIG. 4).

Referring to FIG. 3, in game 1, Darlene and Bill each made ten spares; however, based on conventional pin-count scoring, Darlene easily wins the game. In game 2, each of the players made five strikes but, due to better grouping of the strikes, Darlene is able to eke out a narrow victory, bowling 11 frames to Bill's 10 frames for the win. As will be observed, even though both players were of comparable skill in the sense of making the same numbers of strikes and spares in the two games of FIG. 3, the breaks of the game afforded by conventional playing methods lead to Darlene's winning both games.

If the two games of FIG. 3 are played, however, in accordance with the method of the present invention, the results, shown in FIG. 4, afforded a much more accurate representation of the relative skills of the two players 4 and, in fact, each player wins one of the two games. As will be noted, in game 1, the two players had identical scores through the 11th frame, but Bill's failure to knock 7 down all of the pins in the 12th frame cost him the game.

In game 2, Darlene was leading in the 10th frame, but Bill knocked down all pins with the first ball in the 11th and 12th frames, giving him a very close win and a very exciting finish.

Having described my invention in such terms as to enable those skilled in the art to understand and practice it, and having identified the presently preferred embodiment thereof, I claim:

1. A method of playing a bowling game in which players are allowed a preselected maximum number of balls to knock down all pins in each of a preselected plurality of frames, said method comprising:

(a) requiring each player to deliver at least one of said preselected maximum number of balls in each of said frames;

(b) counting the number of balls delivered by each player in each frame and the number of each player's pins remaining standing at the end of said frame;

(c) adding the number of balls delivered by each player in each frame to the number of each player's pins remaining standing at the end of said frame, to determine a score for each player for each frame;

(d) recording each player's frame score;

(e) adding each player's frame scores to determine said player's total score for the game; and (f) comparing the players' game scores to determine the winner of the game.

* * * * *